US011320786B2

(12) United States Patent
Vannod et al.

(10) Patent No.: US 11,320,786 B2
(45) Date of Patent: May 3, 2022

(54) MAINSPRING

(71) Applicant: Nivarox-FAR S.A., Le Locle (CH)

(72) Inventors: Jonas Vannod, Bienne (CH); Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 435 days.

(21) Appl. No.: 16/401,300

(22) Filed: May 2, 2019

(65) Prior Publication Data

US 2019/0369558 A1 Dec. 5, 2019

(30) Foreign Application Priority Data

Jun. 1, 2018 (EP) ..... 18175570

(51) Int. Cl.
*G04B 1/14* (2006.01)

(52) U.S. Cl.
CPC ..... *G04B 1/145* (2013.01)

(58) Field of Classification Search
CPC ..... G04B 1/145; G04B 1/14; G04B 1/18
See application file for complete search history.

(56) References Cited

U.S. PATENT DOCUMENTS 2,192,101 A * 2/1940 Peskin ..... G04B 1/18 267/156
3,433,011 A * 3/1969 Isekil ..... G04B 1/14 368/140
4,464,216 A 8/1984 Gardiner
9,823,624 B2 * 11/2017 Tsuchiya ..... G04B 1/10
2001/0030908 A1 * 10/2001 Moteki ..... G04C 3/143 368/140
2007/0133355 A1 * 6/2007 Hara ..... C22C 30/00 368/140
2015/0309475 A1 * 10/2015 Kaelin ..... G04B 1/145 368/142

FOREIGN PATENT DOCUMENTS

CH 712 533 A2 12/2017
JP 2017-142215 8/2017

OTHER PUBLICATIONS

European Search Report dated Nov. 30, 2018 in European Application 18175570.3, filed on Jun. 1, 2018 (with English translation of cateogories of Cited Documents).
Combined Chinese Office Action and Search Report dated Aug. 31, 2020, in Patent Application No. 201910455016.4 (with English translation), 13 pages.

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece mainspring including, in the manufactured state, an eye and a portion formed of coils with an outer coil of radius R, the eye and the portion formed of coils being connected by a neck portion having substantially zero curvature, the timepiece mainspring wherein the neck portion has a length $L_C$ comprised between 1.5 and 10 times, and preferably between 2 and 8 times, the radius R. The mainspring having this specific geometry reduces the risk of premature breakage during use, typically for an application with a k factor lower than 10.

10 Claims, 1 Drawing Sheet

MAINSPRING

CROSS-REFERENCE TO RELATED APPLICATION

This application claims priority to European Patent Application No. 18175570.3 filed on Jun. 1, 2018, the entire disclosure of which is hereby incorporated herein by reference.

FIELD OF THE INVENTION

The present invention relates to the field of horology and more specifically to a mainspring which, at the end of its manufacturing process, has an area of substantially zero curvature and of increased length.

PRIOR ART

In a known manner, mainsprings are preformed by a calendering process to ensure a stress greater than the elastic limit over the entire length of the spring when it is placed inside the drum. This guarantees that, in use, the spring can provide all the available energy. A calendering method for mainsprings is, for example, disclosed in CH Patent No. 712533. In addition to the calendered portion, the spring includes an eye of reverse curvature to that of the calendered portion and separated from the latter by a neck portion of length $L_C$ having zero curvature as shown in FIG. 1 of the aforementioned document.

To avoid breakage of the spring mounted inside the barrel drum over time, it is recommended to maintain a k factor, which is the ratio of the barrel core radius to the thickness of the spring, greater than or equal to 10. It is, however, advantageous to work with a core radius of smaller dimensions, i.e. with a reduced k factor, which allows a higher number of coils to be wound around the core. However, in these configurations with a low core radius, in the wound state, the spring is subjected to significant variations in curvature likely to weaken the spring at the beginning of the calendered area just after the neck portion, since the stress in that location is such that it is close to the elastic limit of the spring. Indeed, the difference in curvature between the wound state of the spring and the manufactured state is very pronounced in this area. There follows a signification plastic deformation of the spring when it is first wound, with the corollary of a risk of premature breakage.

SUMMARY OF THE INVENTION

It is an object of the present invention to overcome the aforecited drawbacks by proposing a mainspring configured to reduce its plastic deformation at the critical location when the mainspring is arranged in position in the wound state.

To this end, the present invention proposes to lengthen the neck portion of substantially zero curvature preceding the calendered portion. More precisely, the length of the neck portion is adjusted to be comprised between 1.5 and 10 times, and preferably between 2 and 8 times, the external radius of the calendered portion at the end of the manufacturing process.

The spring according to the invention is particularly suited to applications with a small barrel core radius allowing a higher number of turns of winding. It is thus more specifically adapted for k values lower than 10.

The geometry of the spring according to the invention also ensures good performance of the spring with an efficiency greater than or equal to 80% between winding and unwinding.

Other features and advantages of the present invention will appear in the following description of preferred embodiments, given by way of non-limiting example, with reference to the annexed drawings.

DETAILED DESCRIPTION

Figure 1:
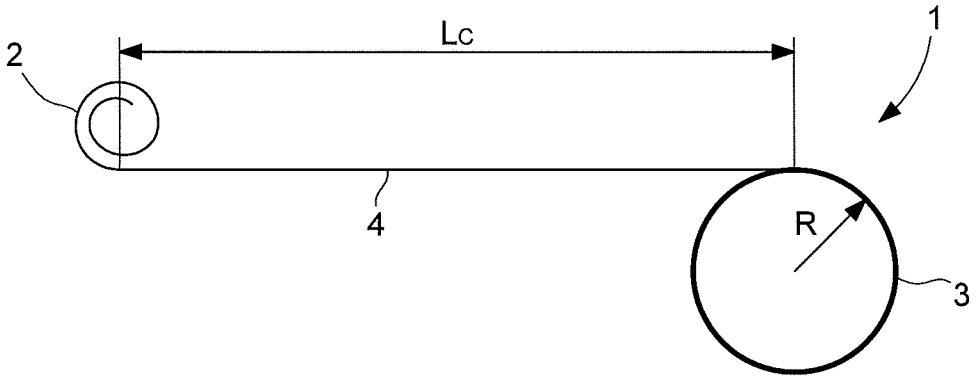
FIG. 1 represents a plan view of the mainspring according to the invention having an increased neck length Lc.

The present invention relates to a mainspring 1 represented in FIG. 1 in the manufactured state. The 'manufactured state' means the initial state at the end of manufacturing, before assembly inside the barrel drum. The mainspring according to the invention is more specifically adapted to applications with a k factor (ratio of the barrel core diameter to the spring thickness) higher than or equal to 5 and lower than 10. It includes, in a conventional manner, an eye 2 and a portion 3 formed of coils with an outer coil of radius R. The coils can touch each other as represented in FIG. 1 or be remote from each other (not represented). Eye 2 is connected to portion 3 by a neck portion 4 having substantially zero curvature forming an area of inflection between eye 2 and portion 3 of reverse curvature to that of the eye. Eye 2 and portion 3 formed of coils are manufactured in a known manner, for example by hammering and calendering respectively.

According to the invention, the neck portion has the characteristic of having an increased length $L_C$ compared to prior art springs which typically have lengths $L_C$ smaller than or equal to radius R of the outer coil. More precisely, in the manufactured state, this length $L_C$ is greater than the external radius R of portion 3, with values comprised between 1.5 and 10 times radius R and preferably between 2 and 8 times radius R. Typically, external radius R is comprised between 2 and 10 mm. By way of example, the mainspring according to the invention has a radius R of 5 mm and a length $L_C$ of 40 mm. Its other dimensions are as follows: a total deployed length of 500 mm, a thickness of 90 μm and an eye diameter adjusted for a core diameter of 1.5 mm, i.e. typically comprised between 1 mm and 1.5 mm.

As a result of increased length $L_C$, the difference in curvature between the wound state and the manufactured state is reduced at the beginning of the calendered area. Hence, the plastic deformation experienced by the spring is lower when it is first wound, which limits the risk of premature breakage.

Figure 2:
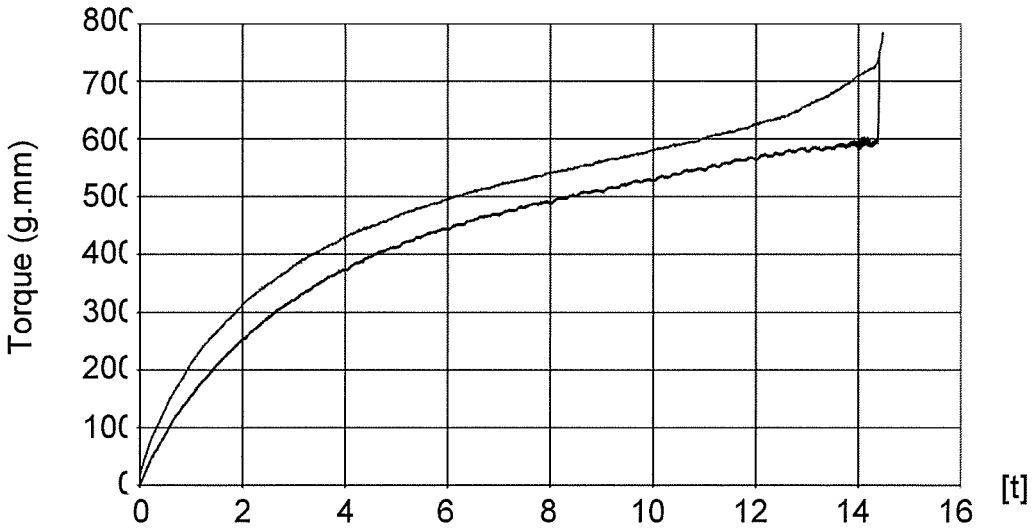
FIG. 2 is a diagram showing the winding curve (upper curve) and unwinding curve (lower curve) of the mainspring according to the invention.

The mainspring according to the invention thus enjoys optimised geometry, which reduces its fragility during use. Further, torque measurements during winding and unwinding demonstrated that this spring geometry ensures good performance of the spring, with an efficiency greater than or equal to 80% between the torque provided during unwinding and that required for winding. By way of example, FIG. 2 represents the winding curve (upper curve) and unwinding curve (lower curve) for measurements made after a half-turn of unwinding. For this example, efficiency of 84% was obtained.

The mainspring according to the invention can, for example, be made from an austenitic stainless steel or a cobalt-nickel-chromium Nivaflex® alloy containing from 44 to 46 wt. % of cobalt, from 20 to 22 wt. % of nickel, from 17 to 19 wt. % of chromium, from 4 to 6 wt. % of iron, from 3 to 5 wt. % of tungsten, from 3 to 5 wt. % of molybdenum, from 0 to 2 wt. % of titanium, from 0 to 1 wt. % of beryllium.

The invention claimed is:

1. A timepiece mainspring, comprising, in an initial state at the end of manufacturing before assembly in a barrel drum:

an eye;

a portion formed of coils with an outer coil having a radius; and a neck portion configured to connect the eye and the portion formed of coils, wherein the neck portion has substantially zero curvature, and the neck portion has a length comprised between 1.5 and 10 times the radius.

2. The mainspring according to claim 1, wherein the length comprised between 2 and 8 times the radius.

3. The mainspring according to claim 1, wherein the radius is comprised between 2 and 10 mm.

4. The mainspring according to claim 1, wherein the portion is formed of coils that touch each other.

5. The mainspring according to claim 1, wherein the portion is formed of coils that are remote from each other.

6. The mainspring according to claim 1, wherein the mainspring is intended for applications with a k factor higher than or equal to 5 and lower than 10.

7. The mainspring according to claim 1, wherein, after assembly inside the barrel drum, an efficiency between a torque supplied during unwinding of the mainspring and a torque required for winding is higher than or equal to 80%.

8. The mainspring according to claim 1, wherein the mainspring is made from an alloy of cobalt-nickel-chrome, containing from 44 to 46% wt. % of cobalt, from 20 to 22 wt. % of nickel, from 17 to 19 wt. % of chromium, from 4 to 6 wt. % of iron, from 3 to 5 wt. % of tungsten, from 3 to 5 wt. % of molybdenum, from 0 to 2 wt. % of titanium, and from 0 to 1 wt. % of beryllium.

9. The mainspring according to claim 1, wherein the mainspring is made from an austenitic stainless steel.

10. A timepiece, comprising:

a mainspring including, in an initial state at the end of manufacturing before assembly in a barrel drum;

an eye;

a portion formed of coils with an outer coil having a radius; and a neck portion configured to connect the eye and the portion formed of coils, wherein the neck portion has substantially zero curvature, and the neck portion has a length comprised between 1.5 and 10 times the radius.

* * * * *